US006149334A

United States Patent [19]

Nicoll

[11] Patent Number: 6,149,334

[45] Date of Patent: Nov. 21, 2000

[54] CONTAINERS

[75] Inventor: Roy Nicoll, Wokingham, United Kingdom

[73] Assignee: The Gillette Company, Boston, Mass.

[21] Appl. No.: 09/312,976

[22] Filed: May 17, 1999

Related U.S. Application Data

[63] Continuation of application No. PCT/US97/18900, Oct. 14, 1997.

[30] Foreign Application Priority Data

Nov. 25, 1996 [GB] United Kingdom ..... 9624425

[51] Int. Cl.[7] ..... A46B 11/00

[52] U.S. Cl. ..... 401/122; 401/121

[58] Field of Search ..... 401/122, 121, 401/118, 126, 129

[56] References Cited

U.S. PATENT DOCUMENTS

| | | | |
|---|---|---|---|
| 1,553,705 | 9/1925 | Maxedon | 401/121 |
| 1,743,204 | 1/1930 | Freeman | 401/122 |
| 2,703,898 | 3/1955 | Kellett | 401/122 |
| 4,761,088 | 8/1988 | Zubek | 401/122 |
| 4,984,920 | 1/1991 | O'Neill | 401/127 |

FOREIGN PATENT DOCUMENTS

| | | |
|---|---|---|
| 4129585 | 3/1993 | Germany . |
| 19516764 | 11/1996 | Germany . |
| 9515096 | 6/1955 | WIPO . |
| 9520496 | 8/1995 | WIPO . |

*Primary Examiner*—David J. Walczak
*Attorney, Agent, or Firm*—Fish & Richardson P.C.

[57] ABSTRACT

A correction fluid bottle (1) has a neck insert (4) defining a passage through which an applicator brush can be passed, and an inner end of the insert is terminated in a steeply inclined plane to define a tapered protrusion (15) extending into the bottle for drops of fluid running back through the neck to collect at the free end of the protrusion and fall back into the bottle, thereby avoiding a build up of dried fluid at the inner end of the neck.

23 Claims, 5 Drawing Sheets

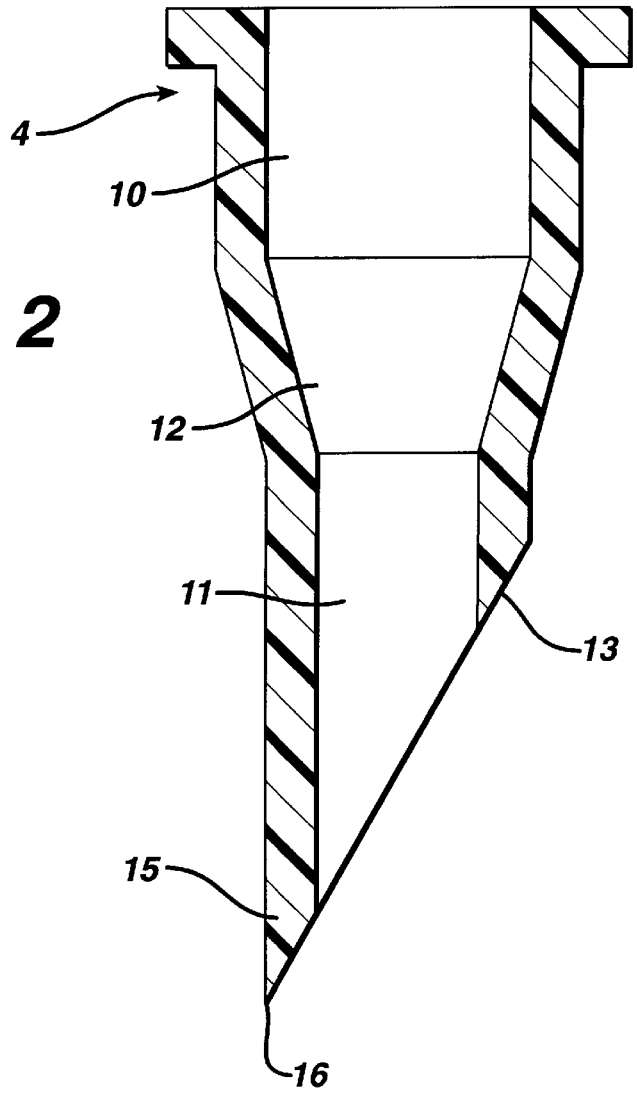
FIG. 2
FIG. 1
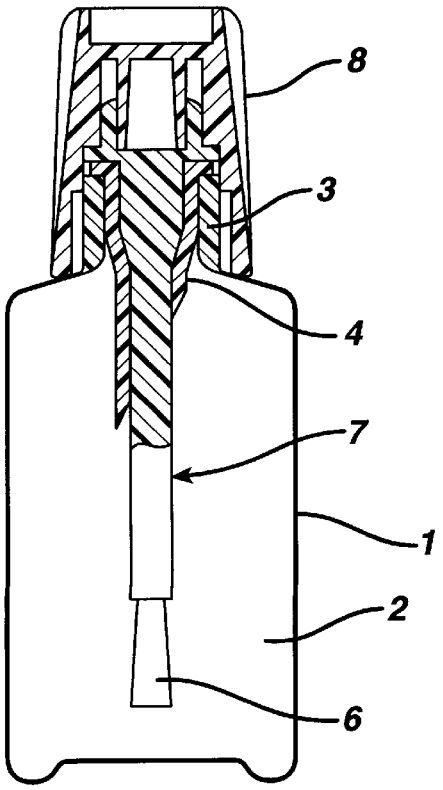

CONTAINERS

This application is a continuation of application International Application PCT/US97/18900 filed on Oct. 14, 1997 and which designated the U.S., claims the benefit thereof and incorporates the same by reference.

This invention is concerned with containers, and is particularly related to containers for correction fluids which are commonly used to cover mistakes when making writing or typing corrections.

Correction fluid is commonly supplied in a bottle equipped with an applicator, typically a brush or pad mounted at the end of a stem carried by a cap of the bottle. It is well known for correction fluid bottles to be fitted with neck inserts. The neck insert is generally tubular and defines a passage through which the applicator is withdrawn from and inserted into the bottle. The neck has two functions. Firstly, it prevents excessive amounts of fluid being withdrawn from the bottle on the applicator. Secondly, by projecting into the storage chamber defined with the bottle, it can serve to prevent spillage should the bottle be accidentally tipped onto its side when the cap is removed.

Correction fluids by virtue of their purpose need to be quick drying. As a result of this nature of the fluids, there is a problem that fluid tends to dry within the neck of the bottle and to build up within the neck eventually impeding passage of the applicator into and out of the bottle. As a solution to this problem, it has been proposed according to our previous Patent Application No. WO 95/15096 to provide the applicator stem with a scraping section for scraping fluid from the neck passage when the stem is rotated during screwing the cap onto and unscrewing the cap from the bottle.

It has been found that there is also a tendency for fluid to run back through the neck and collect at the inner end of the neck insert, so that the neck passage can become severely restricted at this location. With some types of fluid it is even possible for a complete film of fluid to form across the end of the passage and dry so that the passage is blocked. Forcing the applicator through a blocked or partially blocked neck can damage the applicator. It will be appreciated that the inner end of the neck can no be scraped by the applicator stem until after the applicator has been pushed through the neck.

The present invention addresses the problem explained above and as a solution the invention provides a container for correction fluid comprising a chamber, a neck defining passage leading from the chamber, the neck having an annular inner end with at least one protrusion extending therefrom into the chamber, without radially confining the passage as defined at the inner end of the neck, for drops of fluid running back through the neck to collect at the free end thereof and fall back into the chamber.

By providing a protrusion at the inner end of the neck build up of fluid in this region is prevented, and as a result constriction of the inner end of the neck passage by dried fluid is avoided.

The protrusion or protrusions conveniently extend substantially parallel to the axis of the passage and to encourage drops of fluid to fall under gravity from the free lower end of a protrusion, the protrusion preferably tapers to a point.

Although one or maybe more protrusions can be used, very satisfactory results are achievable with a single protrusion. The protrusions could be formed by teeth or spikes integral with a neck insert, or by separate elements, e.g. pins fastened to the neck. However, according to an especially convenient embodiment the protrusion is defined by an inclined inner end face of the neck insert. The end face may be at an angle of less than 45°, e.g. 20°–40°, to the axis of the neck passage.

An exemplary embodiment of the invention will now be described in more detail with reference to the accompanying drawings, in which:

FIG. 1 is an axial cross-section through a correction fluid dispenser according to the invention;

FIG. 2 shows the neck insert in axial cross section and on an enlarged scale;

Figure 3:
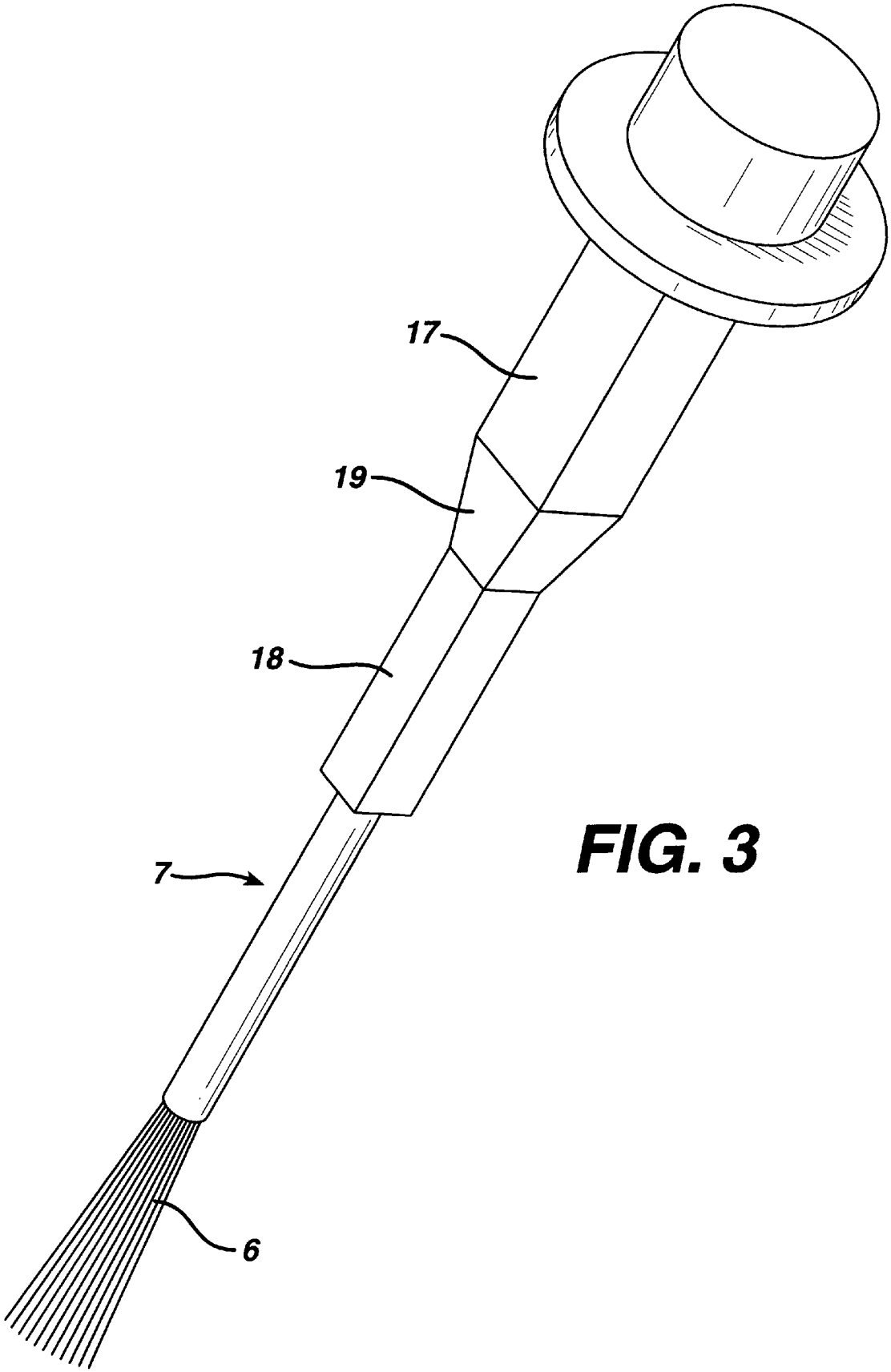
FIG. 3 is a perspective view showing the applicator brush and the stem carrying it.
Figure 4:
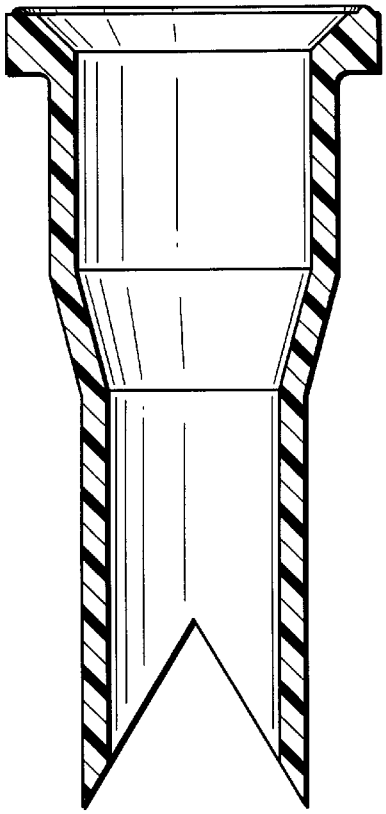
FIG. 4 is an axial cross-section through a correction fluid dispenser neck according to an alternate embodiment of the invention, in which the neck includes two protrusions.
Figure 4A:
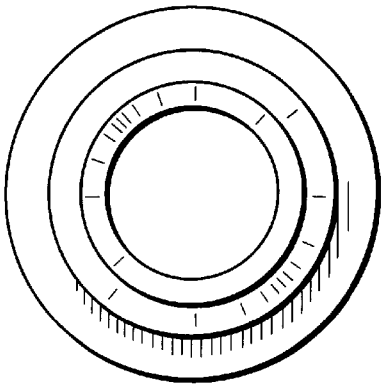
FIG. 4A is an end view of the correction fluid neck.
Figure 5:
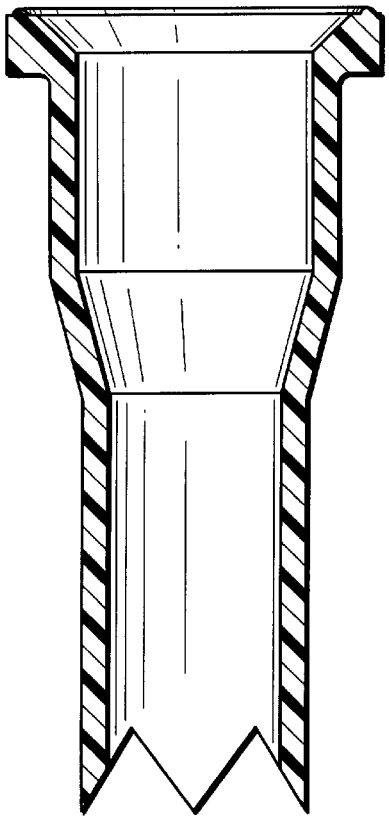
Figure 5A:
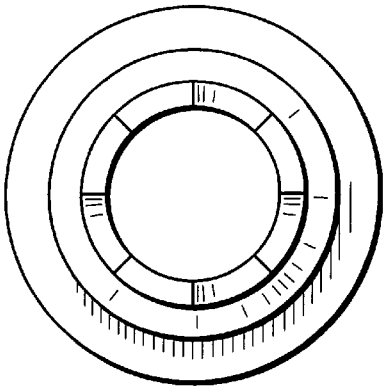
Figure 6:
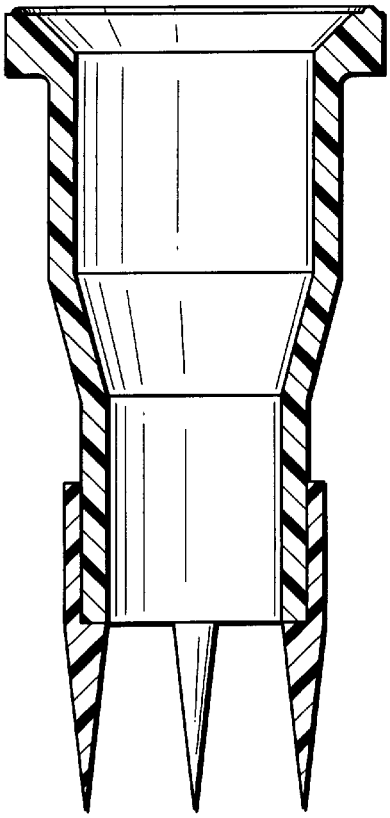
Figure 6A:
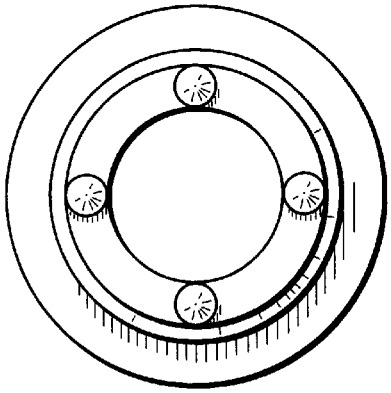

FIGS. 5 and 5A, and FIGS. 6 and 6A are cross-sectional and end views of correction fluid dispenser necks according to further alternate embodiments of the invention, in which the neck includes a plurality of protrusions.

The correction fluid container illustrated in FIG. 1 comprises a conventional moulded plastics bottle 1 defining an interior chamber 2 for storage of correction fluid and having an integral neck section 3 which is externally screw threaded and which defines an opening into which a neck insert 4 is fitted with a good friction fit. The neck insert has an external flange at its outer end to rest on the rim of bottle neck section, and form a neck passage for an applicator. As shown the applicator consists of a brush 6 mounted at one end of a stem 7, the outer end of the stem being attached to the bottle cap 8 which is internally screw-threaded for co-operation with the external thread on the neck section 3.

The passage formed by the neck insert 4 includes a mouth portion 10 (FIG. 2) of relatively large diameter, an inner throat portion 11 of smaller diameter, and an intermediate tapering portion 12. The inner end face 13 of the insert 4 lies in a plane inclined to the axis of the passage at an angle of 30°. As a consequence the inner end of the neck defines a protrusion 15 which tapers to a sharp point 16. Correction fluid running down the inner surface of the neck passage having been deposited on this surface such as during withdrawal of the applicator brush 6 through the neck passage, or by the user wiping fluid from the brush by means of the edge of the insert mouth, runs straight down under gravity until it reaches the bottom edge, but it does not immediately fall from this edge due to surface tension. Instead, and due to the steep inclination of the inner end face 13, the drops of fluid flow around the bottom rim towards the extremity of the protrusion 15 where they collect and join together until their combined weight is sufficient to overcome the surface tension and the drop of fluid falls from the point 16 of the protrusion 15 into the chamber 2 in the bottle. It may be noted that should a drop of fluid remain and dry at the point of the protrusion, as depicted in broken line in FIG. 2, it does not seriously impeded passage of the applicator brush because the inclined face 13 defines a relatively large opening at the inner end of the neck and the brush is easily deflected laterally to pass over the dried fluid.

For removing any fluid from within the neck passage the applicator stem 7 is shaped to scrape the surface of the passage. Thus, the stem 7 has parts 17, 18 each of uniform square cross section for cleaning the mouth and throat portions 10, 11 of the neck passage, respectively, and a tapered part 19 of square cross-section for clearing fluid from the tapered portion 12 of the neck passage. As the cap 8 is screwed onto the bottle neck the parts 17, 18, 19 of the stem are rotated to clean the respective portions of the passage.

While it is apparent that modifications and changes can be made within the spirit and scope of the present invention, it is our intention, however, only to be limited by the appended claims.

What is claimed is:

1. A container for correction fluid comprising a body, defining a chamber and an opening, and a neck extending into the chamber from the opening to define an elongated passage having an open annular end, the neck including a protrusion constructed to cause correction fluid within said passage to flow towards said protrusion and form a droplet at said protrusion, wherein said protrusion extends from said neck substantially parallel to a longitudinal axis of said passage.

2. A container according to claim 1 wherein the protrusion tapers to a point at its lower end.

3. A container according to claim 1, further comprising one or more additional protrusions.

4. A container according to claim 1, wherein the protrusion is defined by an inclined inner end face of the neck.

5. A container according to claim 4, wherein said inner end face is inclined at an angle of from 20 to 40 degrees.

6. A container according to claim 1, wherein said chamber includes an opening and said neck comprises a neck insert constructed to fit into said opening.

7. A container according to claim 1 wherein an applicator is carried on a stem attached to a cap of the container, and the stem is arranged to scrape fluid from the neck passage when the cap is applied to the container.

8. A container according to claim 1 wherein said protrusion comprises an inclined surface.

9. The container of claim 8 wherein said protrusion is integral with said neck.

10. A container according to claim 1 wherein said protrusion is constructed to allow said droplet to fall into said chamber.

11. A container according to claim 1 wherein said protrusion is constructed to minimize radial constriction of said annular end if said droplet solidifies at said protrusion.

12. A correction fluid product comprising:

a correction fluid applicator comprising a cap, an elongated stem mounted on said cap and an applicator tip;

a container comprising a body, defining a chamber and an opening for receiving the correction fluid applicator, and a neck, extending from said opening into said chamber and defining a passage dimensioned to receive said elongated stem, the neck having an open annular end within said chamber and a protrusion, at said annular end, constructed to cause correction fluid within said passage to flow towards said protrusion and form a droplet at said protrusion, wherein said protrusion extends from said neck substantially parallel to a longitudinal axis of said passage; and a correction fluid within said chamber;

said applicator being constructed to be stored within said container when said correction fluid product is not in use.

13. The correction fluid product of claim 12 wherein said protrusion comprises an inclined surface.

14. The correction fluid product of claim 13, wherein said inclined surface is inclined at an angle of from 20 to 40 degrees.

15. The correction fluid product of claim 13 wherein said protrusion is defined by an inclinded inner end face of the neck.

16. The correction fluid product of claim 12 wherein said neck includes a plurality of protrusions.

17. The correction fluid product of claim 12 wherein said protrusion tapers to a point at said open annular end.

18. The correction fluid product of claim 12 wherein said neck comprises a neck insert constructed to fit into said opening.

19. The correction fluid product of claim 12 wherein said protrusion is integral with the neck.

20. The correction fluid product of claim 12 wherein said stem is constructed to scrape fluid from said passage when said cap is applied to cover said opening.

21. The correction fluid product of claim 12 wherein said neck is constructed so that said open annular end remains open when said applicator is withdrawn from said container.

22. The correction fluid product of claim 12 wherein said protrusion is constructed to allow said droplet to fall into said chamber.

23. The correction fluid product of claim 12 wherein said protrusion is constructed to minimize radial constriction of said annular end if said droplet solidifies at said protrusion.

* * * * *